US006964554B2

(12) United States Patent
Groenendaal et al.

(10) Patent No.: US 6,964,554 B2
(45) Date of Patent: Nov. 15, 2005

(54) DROP-IN NOZZLE BLOCK FOR STEAM TURBINE

(75) Inventors: John C. Groenendaal, Winter Springs, FL (US); Wilmott G. Brown, Winter Park, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/403,172

(22) Filed: Mar. 31, 2003

(65) Prior Publication Data

US 2004/0191059 A1 Sep. 30, 2004

(51) Int. Cl.[7] ..... F01D 1/02
(52) U.S. Cl. ..... 415/202; 415/209.2; 415/213.1; 415/136
(58) Field of Search ..... 415/202, 136, 415/138, 209.2, 213.1

(56) References Cited

U.S. PATENT DOCUMENTS 2,905,434 A * 9/1959 Hertl ..... 415/202
4,087,201 A 5/1978 Walsh et al.
4,362,464 A * 12/1982 Stock ..... 415/136
4,840,537 A * 6/1989 Silvestri, Jr. ..... 415/202
5,060,842 A 10/1991 Qureshi et al.

FOREIGN PATENT DOCUMENTS

JP 06221103 A * 8/1994 ..... F01D 9/02

* cited by examiner

*Primary Examiner*—Theresa Trieu

(57) ABSTRACT

A drop-in nozzle block (40) formed in two 180° segments (52) that can be simply lowered into position within the nozzle chamber casing of a steam turbine (42). An entire 180° segment can be lowered into position because an inner arcuate portion (58) of the nozzle block fits over and captures mating portions of the casing rather than having the casing capture the nozzle block as in the prior art. Elimination of a hook portion of the casing eliminates the necessity for the prior art procedure of rotating 90° segments into position through an arcuate-shaped slot. The drop-in installation allows closer tolerances to be maintained between the nozzle block and the casing, thereby eliminating the need for the expansion pins used in the prior art. The use of two 180° segments rather than the prior art 90° segments also eliminates the need for a dogleg joint between segments for turbines having eight steam inlet segments. An inner seal surface (68) is formed on an L-shaped hook portion (76) that opens radially outwardly to capture a radially inwardly projecting flange portion (73) of the turbine nozzle chamber casing (46). The hook portion of the nozzle block assembly may be formed to be integral with an inner arcuate portion (52) of the nozzle block or it may be formed separately as part of a bolted clamp ring (88) or a shrink-fit retaining ring (116). Inner and outer arcuate seal surfaces (74, 72) of the nozzle block may be axially displaced relative to each other.

24 Claims, 4 Drawing Sheets

DROP-IN NOZZLE BLOCK FOR STEAM TURBINE

FIELD OF THE INVENTION

This invention relates generally to the field of steam turbines and more particularly to the nozzle block of a high-pressure steam turbine

BACKGROUND OF THE INVENTION

It is known to position a nozzle block assembly in a steam turbine just downstream of the steam inlet nozzle chamber and upstream of the first row of rotating blades. The nozzle block is an arcuate shaped device that contains a plurality of openings between flow-directing vanes for directing the steam flow in a desired direction toward the first row of blades. The nozzle block must extend completely around the full 360° arc of the rotating blade path, but it is formed in a plurality of individual arc segments to facilitate its manufacture and installation.

FIG. 1 is an end view of a prior art nozzle block 10 that if formed by four 90° segments 12 joined at horizontal and vertical locations around the arc circumference. Each segment 12 includes a plurality of flow-directing vanes 14 defining openings through a central portion of the nozzle block 10 for passing and directing steam flow from the steam inlet nozzle chamber to the first row of rotating blade of a steam turbine. The direction of steam flow is generally parallel to an axis 8 of rotation of a rotor of the steam turbine (i.e. perpendicular to the plane of the view of FIG. 1). The rotor axis 8 of any such turbine defines radial directions perpendicular to the axis 8 (i.e. in the plane of the view of FIG. 1). The term "radially inwardly" is used herein to refer to a direction toward such an axis 8 and the term "radially outwardly" is used herein to refer to a direction away from such an axis 8. The number of nozzle block segments providing steam to the steam inlet nozzle chamber may vary for different turbine designs. Typically there may be four, six or eight steam inlet segments in steam turbines used in electrical power generating plants.

It is desirable to allow the steam from a given inlet nozzle to flow into only a partial arc of the rotating blades to accommodate low power operation. To accomplish this flow separation, flow blockage devices are positioned at predetermined locations around the arc of the nozzle block 12 to separate the circumferential flow of steam. Such blockage devices are preferably placed at the location of a joint between two segments 12 to simplify the manufacturing process. Conversely, at joint locations where no blockage is desired, the segment joints must accommodate the geometry of the vanes 14 without restriction of the steam flow. FIG. 2 is a partial top view of the joint 16 between segments 12 that is located at the top or bottom vertical position. This position will typically not include a flow blockage device for steam turbines having a total of eight steam inlet segments, such as model BB 44 turbines provided by the assignee of the present invention. To accommodate the angular positioning of the flow-directing vanes 14, the joint 16 is formed as a dogleg joint, i.e. the two segments 12 are joined along two intersecting planes rather than along a single plane. There is an increased cost associated with the manufacturing of such a dogleg joint.

A nozzle block 10 will experience significant flow-induced forces during the operation of the turbine. Some older designs were secured in position by a plurality of bolts. More modern turbines provide for the nozzle block segments 12 to be slid or "rolled" into position within a precisely sized arcuate-shaped opening formed in the turbine nozzle chamber casing. Such nozzle block segments 12 are secured with retaining keys to prevent circumferential movement and with expansion pins to limit axial vibration. FIG. 3 illustrates prior art nozzle block 10 in position within the assembled steam turbine 20. The turbine 20 includes a nozzle chamber casing 22 containing a nozzle chamber passage 24 for receiving steam from steam inlet nozzles (not shown). A rotor shaft 26 is rotatably supported about its axis 8 of rotation within the nozzle chamber casing 22 and supports a first row of blades 28 that are fixed to the shaft 26 and moveably sealed against the nozzle chamber casing 22 by a blade tip seal assembly 30. Nozzle block 10 is positioned within an opening formed in the nozzle chamber casing 22 between the nozzle chamber passage 24 and the first row of blades 28. Nozzle block 10 includes a plurality of vanes 14 for directing the steam flow into the blades 28. Nozzle block 10 is forced against the nozzle chamber casing 22 along an outer flange 32 and an inner flange 34 by the pressure of the steam flow to provide a seal against steam flow bypassing vane 14. The terms outer and inner are used herein to denote relative positions along a radius extending from the axis 8 of rotation of the rotor 26.

The nozzle block 10 of FIGS. 1–3 is installed into turbine 20 by sliding the respective segments 12 into an arcuate-shaped opening formed in the nozzle chamber casing 22. This is a difficult process because the clearances are tight and because the segment 12 must be rotated about the rotor axis as it is slid into position within the arcuate-shaped opening. Upper and lower casing halves of the turbine 20 are separated along a horizontal flanged joint and are typically supported on the turbine deck for service operations with the flanged joint side being upward to expose the interior components of the turbine. Each of four 90° segments 12 is then slide into or out of position. The segment arc-lengths are limited to ninety degrees in order to facilitate the installation process. Furthermore, the dimensions of the nozzle block 10 and those of the receiving opening in the nozzle chamber casing 22 are selected to allow a relatively generous clearance of 0.004–0.008 inches to facilitate the installation/removal processes. Even with this large clearance the installation and removal processes are slow and risky and occasionally result in a segment 12 becoming stuck or damaged. Moreover, to limit the level of flow-induced vibration of the nozzle block 10 during turbine operation, and in particular during partial loading of the turbine 20, a plurality of expansion pins 36 are used to urge the nozzle block 10 against the flanges 32, 34. The expansion pins 36 are selected to have a coefficient of thermal expansion that is greater than surrounding materials so that they expand and provide a stabilizing force against the nozzle block 10 when the turbine is at operating temperature, while at the same time shrinking at room temperature to allow the nozzle block 10 to be installed/removed without making contact with the pins.

SUMMARY OF THE INVENTION

A simpler, less expensive, and easier to assemble nozzle block design is needed. Such a nozzle block assembly for a steam turbine is described herein as including: an outer arcuate portion and an inner arcuate portion joined by a plurality of vanes defining flow passages for steam; and a radially outwardly opening hook portion for engaging a casing of the steam turbine. The hook portion may be formed as part of the inner arcuate portion, or as part of a bolted clamp ring disposed against the inner arcuate portion, or as part of a retaining ring disposed against the inner arcuate portion.

A nozzle block assembly for a steam turbine is further described as including a radially outwardly facing hook portion disposed radially inwardly from a plurality of vanes defining passages for directing steam flowing within the steam turbine between a nozzle chamber and a first row of rotating blades. The outwardly facing hook portion may extend along an entire 180° arc segment of the nozzle block assembly or through a lesser arc segment. The outwardly facing hook portion may be formed to be integral with the plurality of vanes or as a member discrete from the plurality of vanes.

A nozzle block for a steam turbine is further described as including: an outer arcuate portion and an inner arcuate portion joined by a plurality of vanes defining flow passages for steam; a seal surface formed on the outer arcuate portion; a seal surface formed on the inner arcuate portion; wherein the outer arcuate portion seal surface is displaced axially along a direction of steam flow from the inner arcuate portion seal surface.

A steam turbine is described as including the nozzle block assembly of the present invention.

BRIEF DESCRIPTION OF THE DRAWINGS

These and other advantages of the invention will be more apparent from the following description in view of the drawings that show.

DETAILED DESCRIPTION OF THE INVENTION

Figure 4:
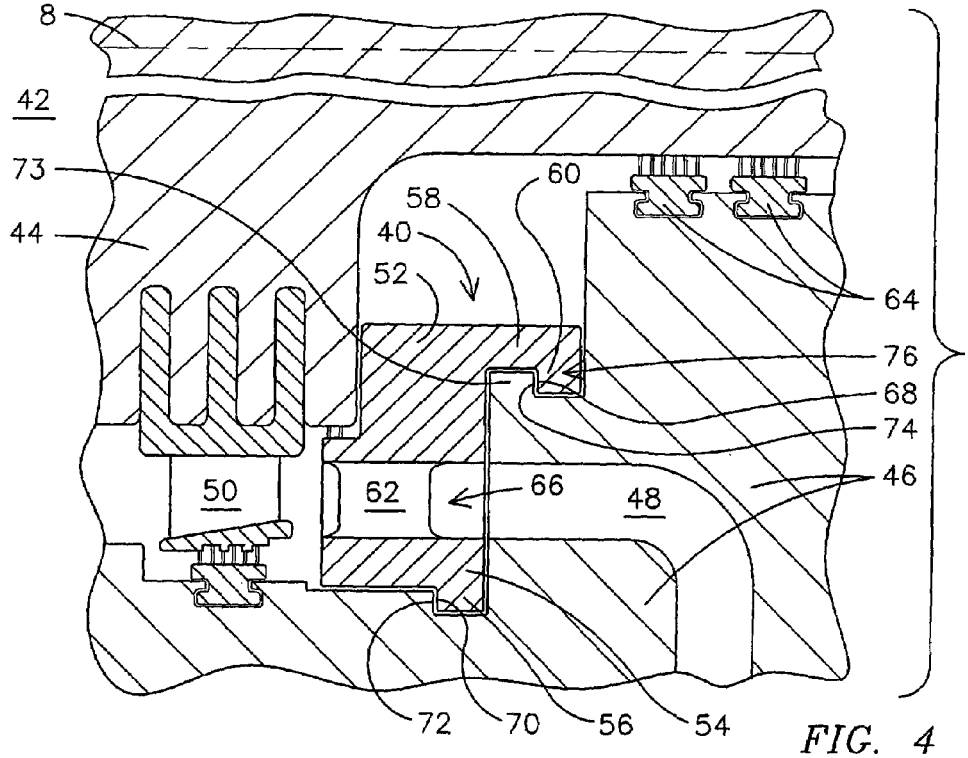
FIG. 4 is a partial sectional view of a turbine utilizing a 180° segment drop-in nozzle block assembly.

An improved nozzle block assembly 40 is shown installed in a steam turbine 42 in FIG. 4. Turbine 42 includes a rotor 44 supported within nozzle chamber casing 46 for rotation about axis 8. The nozzle block 40 is positioned between the nozzle chamber passage 48 and the first row of rotating blades 50. Nozzle block 40 is formed to extend over a 180° arc segment since it does not have to be slid into position but rather is simply lowered into position, as will be described more fully below. Accordingly, only two 180° segments 52 are necessary to extend around the full circumference of the nozzle chamber passage 48. The use of two 180° segments advantageously eliminates the need for a dogleg joint between segments for turbines having eight inlet segments, since the joints may be positioned only at locations where a flow blockage device is desired. Preferably the joints between segments 52 are located along the horizontal axis of the turbine 42 to correspond with the horizontal flanged joint at that location. The top vertical joint where a dogleg joint was required in the prior art is eliminated with the present invention.

Nozzle block 40 includes an outer arcuate portion 54 including an outer flange 56, and an inner arcuate portion 58 including an inner flange 60, joined together by a plurality of vanes 62 that define a respective plurality of flow passages 66 for steam. The terms "inner" and "outer" are used herein to denote relative locations along a radial direction perpendicular to axis 8. The inner and outer flanges 60, 56 define seal surfaces 68, 70 that bear against mating seal surfaces 72, 74 formed in the nozzle chamber casing 46 to provide a seal against bypass flow around the nozzle block 40. Note that the term casing is used herein in a general sense to include the main structural members of the turbine assembly and related structural members attached thereto. The outer flange 56 and seal surfaces 70, 72 are axially displaced (along the axis 8 of the rotor 44 and the direction of steam flow) relative to the inner flange 56 and seal surfaces 68, 74, thereby allowing the nozzle block 40 to be moved vertically into position without interference between the nozzle block 40 and nozzle chamber casing 46. This eliminates the prior art process of rotating the nozzle block into position through an arcuate-shaped slot. During a field service operation, the turbine nozzle chamber casing 46 is split along its flanged seam (not shown) at its horizontal centerline and the two casing halves are separated and laid open for servicing of the turbine components. FIG. 4 illustrates a portion of the bottom half of the nozzle chamber casing 46 with the rotor 44 installed. One may appreciate that with the rotor 44 removed there is no physical obstruction to lowering the 180° segment 52 of nozzle block 40 into place. Similarly, when the top half of the casing (not shown) is laid over on the turbine deck, there is no obstruction to lowering the second 180° segment into the casing top half. Because there is no need to slide the nozzle block 40 into an arcuate slot as was done with prior art devices, the clearance between the nozzle block 40 and surrounding nozzle chamber casing 46 structures may be held to a much closer tolerance than in prior art designs, for example from zero clearance (i.e. an interference fit that is installed by using a temperature differential between interfacing parts) to 0.002 inches clearance. The use of such small clearances further allows the nozzle block 40 to be used without the need for expansion pins or other such stabilizing devices, thereby reducing cost. Standard prior art retaining keys (not shown) may be used to secure the nozzle block 40 against movement within the nozzle chamber casing 46 during assembly and operation of the turbine 42.

The seal surfaces 68, 70 formed on the nozzle block 40 face in a downstream direction relative to the steam flow so that the pressure drop across the nozzle block 40 provides a sealing force against the upstream-facing sealing surfaces 72, 74 formed in the nozzle chamber casing 46 to prevent bypass steam flow around the nozzle block. In the prior art nozzle block 10 of FIG. 3, the inner flange 34 of nozzle chamber casing 22 has an L-shaped cross-section that opens radially outwardly to capture the inwardly projecting L-shaped cross-section of flange 38 of the nozzle block 10. In contrast, the present nozzle block assembly 40 includes an inner flange 60 having an L-shaped cross-section that opens radially outwardly to define a seal surface 74 and to capture the inwardly projecting L-shaped flange section 73 of nozzle chamber casing 46 that defines seal surface 74. In other terms, the prior art uses an outwardly opening "hook" 39 in the casing to capture the inner arcuate portion of the nozzle block whereas the present invention uses an outwardly opening "hook" 76 formed radially inwardly from the vanes 62 along the inner arcuate portion of the nozzle block to capture the casing. By eliminating the outwardly opening hook 39 in the casing of the turbine, the present invention eliminates that portion of the casing that causes the mechanical interference that prevents the simple lowering of the nozzle block into position. By forming the outwardly opening hook portion 76 in the inner arcuate portion 58 of the nozzle block 40 rather than in the turbine casing, the present inventors have provided the desired sealing surfaces 68, 74 in a design that can be simply dropped into place over an entire 180° arc length.

The cost to fabricate and to install/service nozzle block 40 may be significantly reduced from the cost to fabricate and to install/service the prior art nozzle block 10. Cost is reduced by the elimination of a dogleg joint and by the elimination of expansion pins. The time needed to lower nozzle block 40 into place within nozzle chamber casing 46 may be lower than the time needed to rotate/slid nozzle block 10 into an arcuate slot within nozzle chamber casing 22. The risk of damage to the nozzle block 40 may also be reduced because of the simpler drop-in installation process. Note that the positions of rotor seal assemblies 64 may be different in turbine 42 because the inner portion of nozzle chamber casing 46 does not extend as far downstream as would the prior art nozzle chamber casing 22, although the design of the seal may be the same in both applications. The reduction in the mass of nozzle chamber casing 46 when compared to the mass of nozzle chamber casing 22 may provide an additional cost saving.

Figure 5:
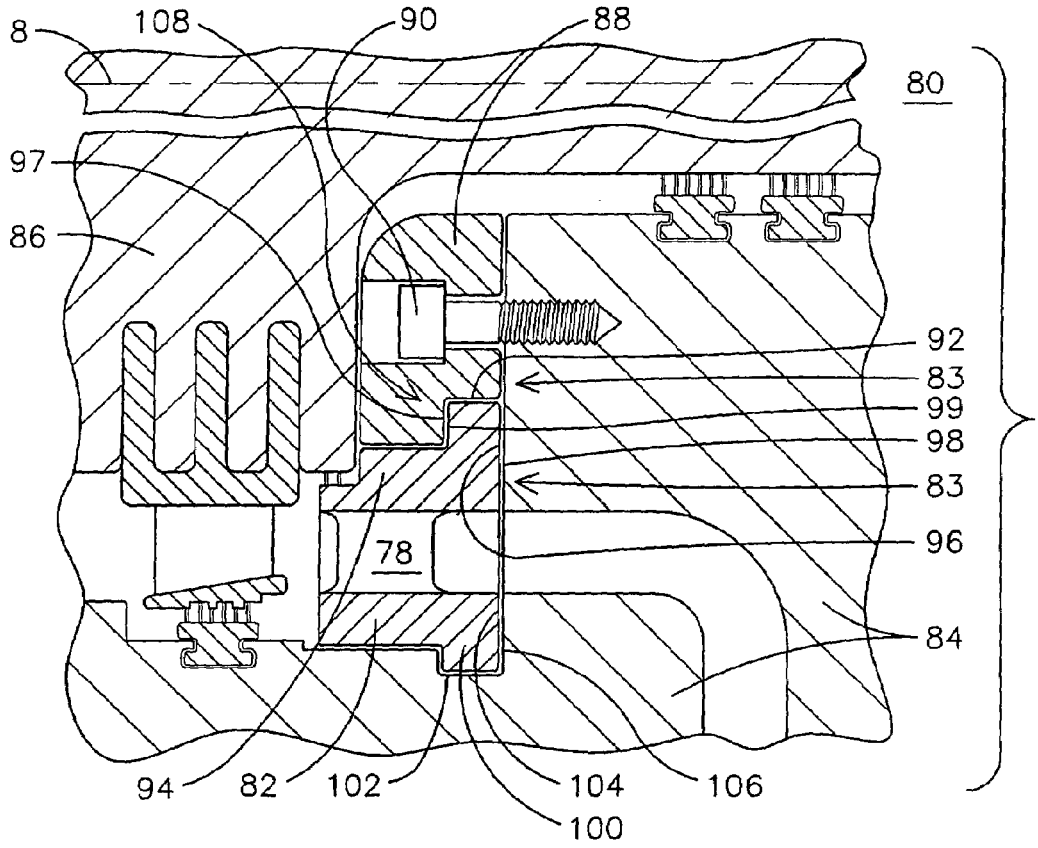
FIG. 5 is a partial sectional view of a turbine utilizing a bolted design of a 180° segment drop-in nozzle block assembly.

FIG. 5 illustrates another embodiment of a turbine 80 utilizing an alternative design of a 180° segment drop-in nozzle block 82. As with the embodiment of FIG. 4, the nozzle block 82 may be simply lowered into position within the nozzle chamber casing 84 when the rotor 86 is removed. A clamp ring 88 is then positioned against the nozzle block 82 and is held in position by a plurality of bolts 90 that are in threaded engagement with the nozzle chamber casing 84. The clamp ring 88 is preferably formed into 180° segments to correspond to the segments of the nozzle block 82, although segments of other arc lengths may be used if desired. Clamp ring 88 includes a groove 92 for receiving the inner arcuate portion 94 of nozzle block 82 and for urging an inner sealing surfaces 96, 97 against respective mating sealing surfaces 98, 99 of the casing when bolts 90 are tightened. Outer arcuate portion 100 of the nozzle block 82 is received by a groove 102 formed in the nozzle chamber casing 84 with a clearance of 0–2 mils, for example. When bolts 90 are tightened, the outer sealing surface 104 of the nozzle block 82 will be urged against sealing surface 106 of the nozzle chamber casing 84, thereby providing an improved seal against steam bypass around the nozzle block 82. The tightening action of bolted clamp ring 88 eliminates the need for expansion pins with this design. The nozzle block 82 and the clamp ring 88 function together as a nozzle block assembly 83.

Figure 1:
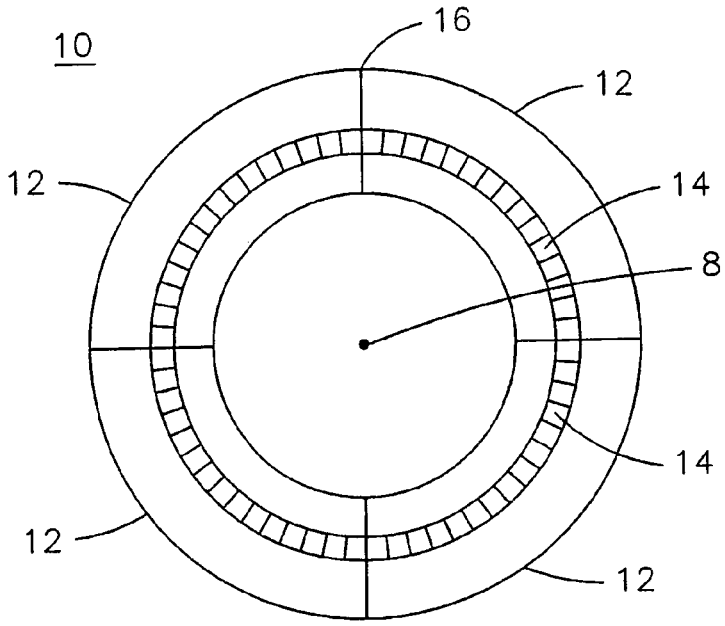
FIG. 1 PRIOR ART
FIG. 1 is a end view of a prior art nozzle block showing a plurality of 90° segments.
Figure 2:
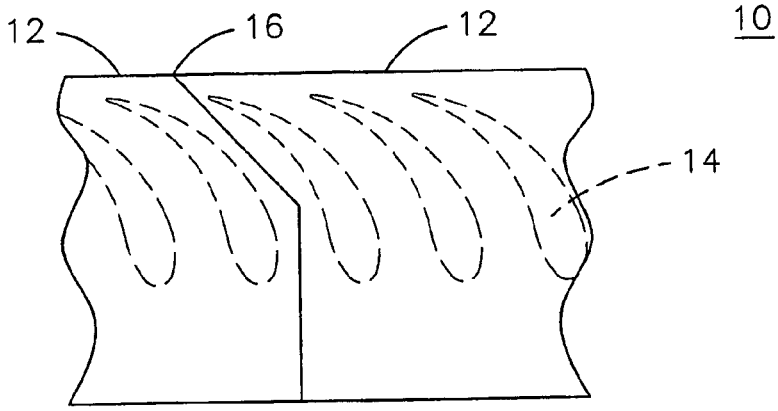
FIG. 2 PRIOR ART
FIG. 2 is a partial top view of the prior art nozzle block of FIG. 1 showing a dogleg joint between segments.
Figure 3:
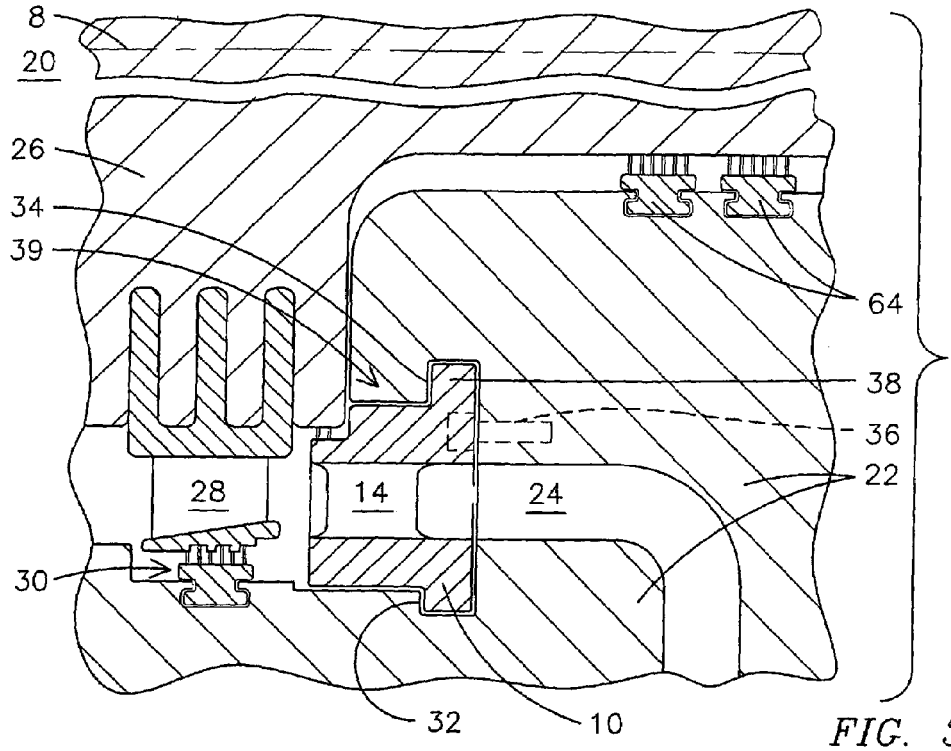
FIG. 3 PRIOR ART
FIG. 3 is a partial sectional view of a prior art turbine utilizing the nozzle block of FIG. 1.

The design of FIG. 5 reduces the mass of the nozzle chamber casing 84 when compared to the nozzle chamber casing 22 of the prior art,design of FIG. 3, since the nozzle chamber casing 84 does not extend axially (i.e. downstream in the direction of the steam flow) beyond the sealing surface 98. The prior art nozzle chamber casing 22 includes a radially outwardly opening hook 39 that extends axially beyond the plane of the sealing surfaces at flange 34. This structure is eliminated by the embodiment of FIG. 5 of the present invention, as it was with the embodiment of FIG. 4. The nozzle chamber casing 84 in this region of the turbine 80 of the present invention extends axially only to the location of sealing surfaces 98, 106. The radially outwardly opening hook 108 that functions as the downstream structure necessary to retain the inner arcuate portion 94 of nozzle block 82 is provided as part of the removable clamp ring 88. Unlike the embodiment of FIG. 4 where the hook portion 76 is formed to be integral with all three of the inner arcuate portion 58, vanes 62 and outer arcuate portion 54, the hook 108 of FIG. 5 is part of the clamp ring 88 and is discrete from the nozzle block portion 82 that includes the inner arcuate portion 94, vanes 78 and outer arcuate portion 100.

Clamp ring 88 may advantageously be formed of a material different from that of the expensive high chromium content alloy typically used for turbine casings, thereby further lowering the overall cost of the turbine 80 when compared to prior art machines. The clamp ring 88 may be formed of the same material as that used to form nozzle block 82 or it may be formed of a different material. This embodiment also eliminates the need for a dogleg joint in some applications since it spans a 180° arc segment.

Figure 6:
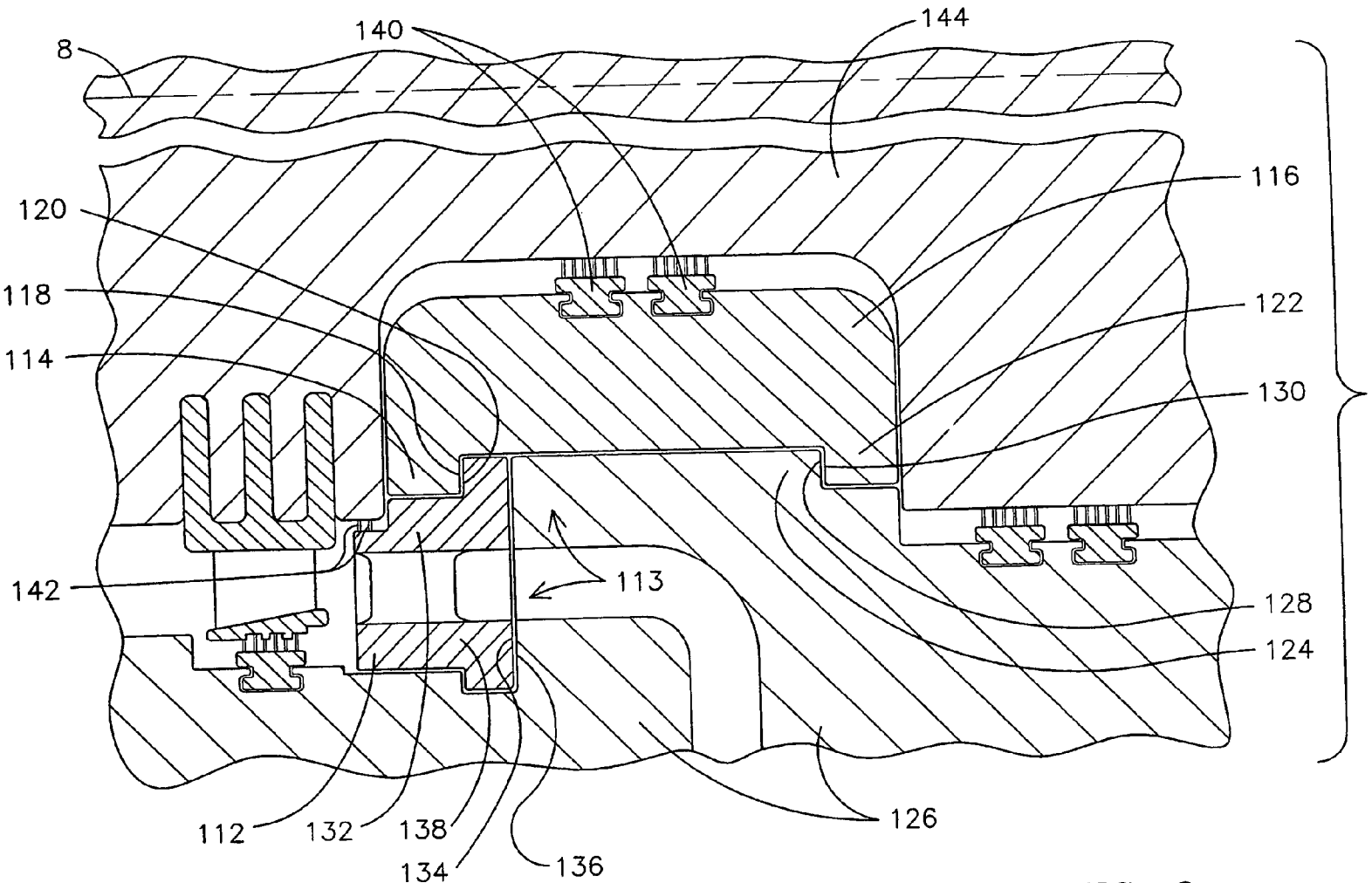
FIG. 6 is a partial sectional view of a turbine utilizing a 180° segment drop-in nozzle block assembly incorporating a retaining ring.

FIG. 6 illustrates a further embodiment of a turbine 110 utilizing a 180° segment drop-in nozzle block 112. This design utilizes a radially outwardly opening hook 114 formed on a removable retaining ring 116 to retain nozzle block 112 and to provide surface 118 for mating with surface 120 on the nozzle block 112. The nozzle block 112 and the retaining ring 116 function together as a nozzle block assembly 113. The retaining ring extends axially in a direction opposed the direction of steam flow and includes an upstream outwardly opening hook 122 for engaging flange 124 on nozzle chamber casing 126 for transfer of the loads imposed on the nozzle dam 112. The retaining ring 116 is preferably formed in two 180° segments, although other length segments may be used.

Advantageously, retaining ring 116 is formed of a material that has a smaller coefficient of thermal expansion than the material of nozzle chamber casing 126 so that the gap provided between sealing surfaces 118, 120 for facilitating the installation of the nozzle block 112 at cold conditions will be reduced, perhaps to zero, as the turbine 110 is heated to operating condition temperatures. This eliminates the need for an expansion pin with this nozzle block design. It also eliminates the need for the use of bolts for securing the ring to the casing, as were described with the clamp ring 88 of the embodiment of FIG. 5. In this regard, the term clamp ring is used herein to include a structure that is affixed to the casing with a fastener of any type, whereas the term retaining ring is used herein in a more general sense to include a structure that is attached to the casing in any manner. The differential thermal growth between retaining ring 116 and the casing 126 provides a closing force between mating inner sealing surfaces 128, 130 for sealing against leakage past the inner annular portion 132 of nozzle block 112. The differential thermal expansion also provides a closing force between mating surfaces 134, 136 for sealing against leakage past the outer annular portion 138 of nozzle block 112. Due to the axial length of the retaining ring 116, it may be desirable to provide a seal such as spring seals 140 on the retaining ring 116 for sealing against rotor 144. A hard seal such as caulked seal 142 may be provided on nozzle block 112 in any of the described embodiments for sealing against rotor 114. As with the other designs described above, the nozzle block 112 of FIG. 6 may be lowered into position in 180° segments without interference with the nozzle chamber casing 126. The retaining ring 116 is then positioned to capture the nozzle block 112. The use of 180° segments eliminates the need for a dogleg joint in some turbine applications.

Figure 7A:
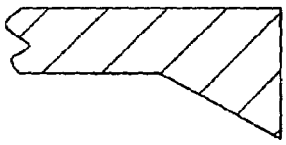
FIGS. 7A–7C illustrate various cross-section shapes for a nozzle block assembly hook portion.
Figure 7B:
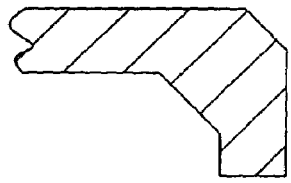
Figure 7C:
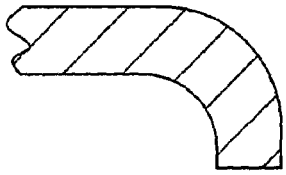

The radially outwardly opening hook portions 76, 108, 114 of the nozzle block assemblies of the present invention are illustrated as having a generally L-shaped cross-section (i.e. right angle surface intersection at both the intrados and extrados of the hook). One skilled in the art will appreciate that other hook shapes may be used provided that no interference is created when lowering a 180° arc segment of the nozzle block into position within the casing. Such other hook cross-sectional shapes may include an intrados surface intersection of greater than 90°, a curved intrados cross-sectional shape, and other extrados shapes, as illustrated generally in FIGS. 7A, 7B and 7C. Furthermore, the hook portions may extend for a full 180° arc or they may be formed along only a portion of the nozzle block 40, clamp ring 88 or retaining ring 116.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A nozzle block assembly for a steam turbine comprising:

an outer arcuate portion and an inner arcuate portion joined by a plurality of vanes defining flow passages for steam, the outer arcuate portion disposed radially outwardly relative to the vanes in a radial direction perpendicular to an axis of rotation of a rotor of the steam turbine, and the inner arcuate portion disposed radially inwardly in the radial direction relative to the vanes;

a radially outwardly opening hook portion associated with the outer arcuate portion for engaging a casing of the steam turbine; and a radially outwardly opening hook portion associated with the inner arcuate portion for engaging the casing of the steam turbine.

2. The nozzle block assembly of claim 1, wherein the inner arcuate portion comprises the radially outwardly opening hook portion associated with the inner arcuate portion.

3. The nozzle block assembly of claim 1, wherein the radially outwardly opening hook portion associated with the inner arcuate portion is formed in a clamp ring disposed against the inner arcuate portion.

4. The nozzle block assembly of claim 3, further comprising a bolt attaching the clamp ring to the casing.

5. The nozzle block assembly of claim 1, wherein the radially outwardly opening hook portion associated with the inner arcuate portion is formed in a retaining ring disposed against the inner arcuate portion.

6. The nozzle block assembly of claim 5, further comprising a seal disposed between the retaining ring and a rotor portion of the steam turbine.

7. The nozzle block assembly of claim 1, further comprising:

an outer sealing surface formed on the outer arcuate portion; and an inner sealing surface formed on the radially outwardly opening hook portion associated with the inner arcuate portion.

8. The nozzle block assembly of claim 7, wherein the inner arcuate portion comprises the inner sealing surface.

9. The nozzle block assembly of claim 7, wherein the inner sealing surface is formed on a clamp ring disposed against the inner arcuate portion.

10. The nozzle block assembly of claim 7, wherein the inner sealing surface is formed on a retaining ring disposed against the inner arcuate portion.

11. The nozzle block assembly of claim 7, further comprising the inner sealing surface being axially displaced from the outer sealing surface.

12. The nozzle block assembly of claim 1, wherein the radially outwardly opening hook portion associated with the inner arcuate portion is formed to be integral with the outer arcuate portion, the inner arcuate portion, and the plurality of vanes.

13. The nozzle block assembly of claim 1, wherein the radially outwardly opening hook portion associated with the inner arcuate portion is formed in a member discrete from a member including the outer arcuate portion, the inner arcuate portion, and the plurality of vanes.

14. The nozzle block assembly of claim 1, further comprising:

the hook portion being formed in a retaining ring disposed against the inner arcuate portion; and the retaining ring comprising a material having a coefficient of thermal expansion that is greater than a coefficient of thermal expansion of the casing.

15. The nozzle block assembly of claim 1, wherein the outer arcuate portion and an inner arcuate portion comprise a 180° arc segment.

16. The nozzle block assembly of claim 15, wherein the radially outwardly opening hook portion associated with the inner arcuate portion comprises a 180° arc segment corresponding to the arc segment of the outer and inner arcuate portions.

17. The nozzle block assembly of claim 15, wherein the radially outwardly opening hook portion associated with the inner arcuate portion comprises an arc segment of less than 180°.

18. A nozzle block assembly for a steam turbine comprising a radially outwardly facing hook portion disposed radially inwardly from a plurality of vanes relative to a radial direction perpendicular to an axis of rotation of a rotor of the steam turbine, the vanes defining passages for directing steam flowing within the steam turbine between a nozzle chamber and a first row of rotating blades.

19. The nozzle block assembly of claim 18, wherein the outwardly facing hook portion extends along an entire 18020 arc segment of the nozzle block assembly.

20. The nozzle block assembly of claim 18, wherein the outwardly facing hook portion is formed to be integral with the plurality of vanes.

21. The nozzle block assembly of claim 18, wherein the outwardly facing hook portion is formed in a member discrete from the plurality of vanes.

22. A nozzle block for a steam turbine comprising:

an outer arcuate portion and an inner arcuate portion joined by a plurality of vanes defining flow passages for steam, the outer arcuate portion disposed radially outwardly relative to the vanes in a radial direction perpendicular to an axis of rotation of a rotor of the steam turbine, and the inner arcuate portion disposed radially inwardly in the radial direction relative to the vanes;

a seal surface formed on the outer arcuate portion;

a seal surface formed on the inner arcuate portion;

wherein the outer arcuate portion seal surface is displaced axially along a direction of steam flow from the inner arcuate portion seal surface.

23. A steam turbine comprising the nozzle block assembly of claim 18.

24. A steam turbine comprising the nozzle block assembly of claim 22.

* * * * *